US012428190B2

(12) United States Patent
Fisher et al.

(10) Patent No.: US 12,428,190 B2
(45) Date of Patent: Sep. 30, 2025

(54) WRAP REMOVAL DEVICE

(71) Applicant: Illinois Tool Works Inc., Glenview, IL (US)

(72) Inventors: Joseph Michael Fisher, Cheektowaga, NY (US); Trevor James Powers, Batavia, NY (US); Michael Patrick Fay Seguin, Niagara Falls, NY (US)

(73) Assignee: ILLINOIS TOOL WORKS INC., Glenview, IL (US)

( * ) Notice: Subject to any disclaimer, the term of this patent is extended or adjusted under 35 U.S.C. 154(b) by 682 days.

(21) Appl. No.: 16/943,731

(22) Filed: Jul. 30, 2020

(65) Prior Publication Data

US 2021/0031958 A1 Feb. 4, 2021

Related U.S. Application Data

(60) Provisional application No. 62/880,889, filed on Jul. 31, 2019.

(51) Int. Cl.
*B65B 61/10* (2006.01)
*B65B 61/00* (2006.01)

(52) U.S. Cl.
CPC ..... *B65B 61/10* (2013.01); *B65B 61/005* (2013.01)

(58) Field of Classification Search
CPC . B26F 3/06; B26F 3/08; B65B 61/005; B65B 61/18; B65B 51/22; B65B 51/225; B65B 51/227; B65B 61/10; B26D 7/086; B26D 7/10
USPC ..... 225/2, 93.5, 94, 96
See application file for complete search history.

(56) References Cited

U.S. PATENT DOCUMENTS 6,823,649 B1 * 11/2004 Pauchet ..... B65B 61/02 53/133.8
9,505,169 B2 * 11/2016 Herrmann ..... B29C 66/9512
10,016,627 B2 * 7/2018 Viitala ..... A61N 7/02
2014/0114272 A1 * 4/2014 Schoon ..... A61F 13/5638 225/2

FOREIGN PATENT DOCUMENTS

CN 202920405 * 5/2013

OTHER PUBLICATIONS

Translation of Shanghai East Hospital (Year: 2013).*
Cusimax Hot Plate, 1500W LED . . . , Jun. 14, 2019, obtained from https://www.amazon.com/Electric-Infrared-Adjustable-Temperature-Compatible/dp/B07T6XR9C5?th=1 on Jul. 6, 2022 (Year: 2019).*
(Continued)

*Primary Examiner* — Evan H MacFarlane
(74) *Attorney, Agent, or Firm* — The Small Patent Law Group LLC; Christopher R. Carroll

(57) ABSTRACT

A wrap removal device includes (a) an engagement surface configured to receive a container having an outer wrapping and (b) one or more delivery elements disposed on or in the engagement surface. The one or more delivery elements are configured to generate energy that one or more of melts, cuts, or weakens the outer wrapping along a path without melting, cutting, or modifying the container. The wrap removal device can quickly remove the outer wrapping without damage to the container.

3 Claims, 4 Drawing Sheets

(56) References Cited

OTHER PUBLICATIONS

Candleers Candle Co, At What Temperature Does Candle Wax Melt (Wax Melting Point), obtained from https://www.candleers.com/at-what-temperature-does-candle-wax-melt/ on Jul. 11, 2022.*
NutriChef Small Countertop Appliance, Size 16.5 x 11 Inches, Stainless Steel, Jun. 12, 2016, obtained from https://www.amazon.com/NutriChef-Electric-Warming-Perfect-Banquets/dp/B01H7VHVSS?source=ps-sl-shoppingads-lpcontext&ref _=fplfs&smid=ATVPDKIKXODER&th=1 on Oct. 25, 2022 (Year: 2016).*
Polymerdatabase.com, Melting Points of Polymers, obtained from https://polymerdatabase.com/polymer%20physics/Polymer%20Tm%20C.html on Feb. 2, 2023.*
Innovia Films Ltd., "Safety Data Sheet Cellophane", CENSAM 3G002, Issue No. 1, 6 pages.

* cited by examiner

WRAP REMOVAL DEVICE

CROSS-REFERENCE TO RELATED APPLICATIONS

This application claims priority to U.S. Provisional Application No. 62/880,889, which was filed on 31 Jul. 2019, and the entire disclosure of which is incorporated herein by reference.

BACKGROUND

Technical Field

The subject matter described herein relates to removing outer wraps or wrappings from containers.

Discussion of Art.

Products may be handled (e.g., shipped, stored, etc.) in containers that have an outer wrap or wrapping. For example, some boxes of product are enclosed within a cellophane or other material wrapping. This outer wrapping can protect the containers during handling, can hold two or more containers together, or the like.

The outer wrapping may need to be removed from the containers. For example, during processing of the products within the containers, the outer wrapping may need to be removed to access the products. This can occur with tobacco products, where the products within the containers may need to be accessed to apply stamp taxes to the products or containers before the products or containers are commercially sold. As another example, the outer wrapping may need to be removed to apply labels or other indicia to the outside of the containers, to allow a consumer to access the products inside the containers, to separate containers from each other, etc.

Currently, the outer wrapping can be removed in a few limited ways. The outer wrapping can be cut using a sharp edge, but this technique risks damaging the container and/or product within the wrapping. The outer wrapping may include a pre-existing perforation or interface between adhered edges of the wrapping. A person can pull apart the wrapping along the perforation or interface (e.g., using a tab or other feature of the wrapping). But, this task is a fine motor skill task that can be time-intensive in a fast-paced situation, such as in a production line that seeks to quickly unwrap products from the wrapping for later processing. Additionally, not all persons are physically able to perform such small motor tasks.

BRIEF DESCRIPTION

In one embodiment, a wrap removal device includes (a) an engagement surface configured to receive a container having an outer wrapping and (b) one or more delivery elements disposed on or in the engagement surface. The one or more delivery elements are configured to generate energy that one or more of melts, cuts, or weakens the outer wrapping along a path without melting, cutting, burning, charring, or otherwise modifying (e.g., not changing the container to a level that negates the value or appearance of the container) the container.

In one embodiment, a wrap removal device includes (a) an engagement surface configured to receive a container having an outer wrapping and (b) one or more delivery elements disposed on or in the engagement surface. The one or more delivery elements are configured to generate heat that one or more of melts or weakens the outer wrapping along a path without melting or modifying the container.

In one embodiment, a wrap removal device includes (a) an engagement surface configured to receive a container having an outer wrapping and (b) one or more delivery elements disposed on or in the engagement surface. The one or more delivery elements are configured to generate ultrasound energy that one or more of cuts or weakens the outer wrapping along a path without cutting or modifying the container.

BRIEF DESCRIPTION OF THE DRAWINGS

The inventive subject matter may be understood from reading the following description of non-limiting embodiments, with reference to the attached drawings, wherein below.

DETAILED DESCRIPTION

Embodiments of the subject matter described herein relate to devices and methods that remove the outer wrap (or wrapping) from containers. The devices and methods may be used to quickly remove this wrapping without damaging or defacing the container(s) within the wrapping. These devices and methods can be used in a high speed processing environment to quickly remove the wrapping, but alternatively can be used in other environments (e.g., where a single wrapping is sought to be removed from container(s), such as where a person wants to unwrap a container). While the description here uses the unwrapping of tobacco product containers for the application of tax stamps to describe the functionality of the wrap removal devices and methods, not all inventive embodiments of the wrap removal devices and methods described herein are limited to tobacco products for the application of tax stamps. One or more embodiments of the wrap removal devices and methods described herein can be used to remove other wrappings, to remove wrappings from other containers, to remove wrappings from containers having other products in the containers, and/or to remove wrappings from containers for purposes other than the application of tax stamps.

Figure 1:
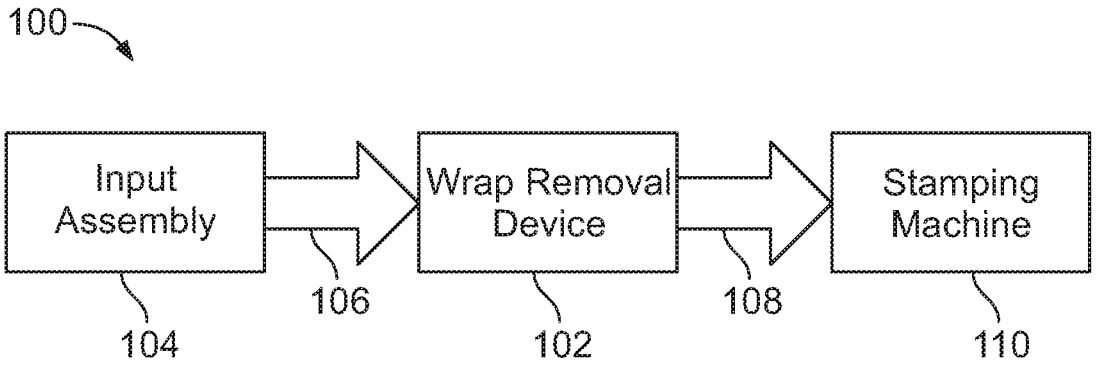
FIG. 1 schematically illustrates one example of a stamping system that includes a wrap removal device.

FIG. 1 schematically illustrates one example of a stamping system 100 that includes a wrap removal device 102. The stamping system 100 includes an input assembly 104 into which wrapped containers are received. This input assembly 104 can be a table, larger container, or the like, into which the wrapped containers are placed or received. For example, operators may place wrapped containers on the input assembly 104, robotic arms may automatically move the wrapped containers onto the input assembly 104, or the wrapped containers may slide, fall, or otherwise be automatically moved onto the input assembly 104 from a powered conveyor, roller gravity conveyor, roller table, etc.

The wrapped containers are moved from the input assembly 104 to the wrap removal device 102 by one or more conveyors 106. The conveyors 106 can represent one or more powered conveyors (e.g., belts that are moved by motors), one or more roller gravity conveyors, one or more roller tables, or the like. Alternatively, the wrapped containers may be manually moved to the wrap removal device 102 or may be moved using other devices (e.g., forklifts, robotic arms, etc.).

The wrap removal device 102 receives containers having outer wrappings and removes the outer wrappings from the containers. As described herein, the wrap removal device 102 can remove the wrappings by applying energy to the outer wrappings to form a path of weakness or to cut through the outer wrappings. This energy that is applied forms a path of weakness or cuts through the outer wrappings without damaging, marking, cutting through, altering, or otherwise changing the underlying containers. For example, the energy that is applied can melt or cut through the outer wrapper without melting, marking, cutting, or defacing the container. Optionally, the energy can form a path of weakness in the outer wrapper that can then be used to remove the outer wrapping. This path of weakness can be one or more perforations formed in the outer wrapping or a path along which the outer wrapping is changed to a weaker state (e.g., the wrapping is thinner) relative to the remainder of the outer wrapping.

The outer wrapping can be manually or automatically removed from the container. For example, an operator can manually grasp and remove the outer wrapping without having to cut the wrapping, without having to grasp any pre-designated portion of the wrapping (e.g., a tab), without having to cut or otherwise alter the wrapping (aside from removing the wrapping from the container), etc. As another example, a robotic arm can automatically grasp and remove the wrapping, the container and wrapping may be moved (e.g., by one or more conveyors 108) over a projection that grasps and holds the wrapping while the container keeps moving, etc. The conveyors 108 can represent one or more additional conveyors 106 that transfer the container with the wrapping removed from the wrap removal device 102 to a stamping machine 110.

The stamping machine 110 represents equipment that applies stamps or indicia to the container with the wrapping removed. For example, the stamping machine 110 can represent a tax stamping machine, a printer, a heat transfer machine, or the like, that applies stamps, labels, ink, or the like, to the containers. Alternatively, the wrap removal device 102 may not be included in a system such as the stamping system 100.

Figure 2:
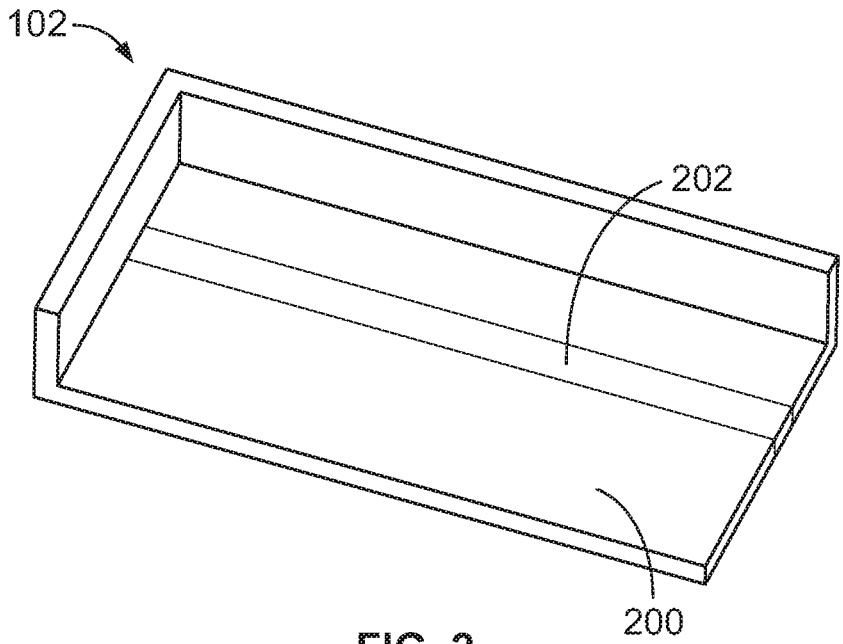
FIG. 2 illustrates a perspective view of one embodiment of a wrap removal device shown in FIG. 1.
Figure 3:
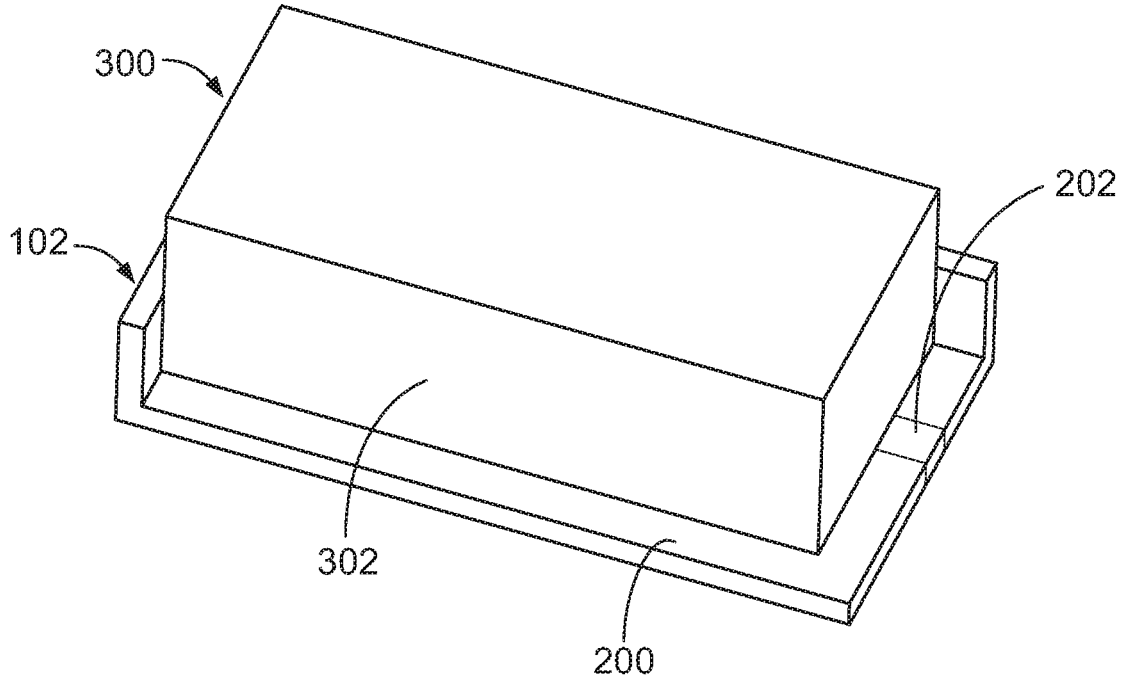
FIG. 3 illustrates the wrap removal device shown in FIG. 1 with a wrapped container engaged with the wrap removal device.

FIG. 2 illustrates a perspective view of one embodiment of the wrap removal device 102 shown in FIG. 1. FIG. 3 illustrates the wrap removal device 102 shown in FIG. 1 with a wrapped container 300 engaged with the wrap removal device 102. The wrap removal device 102 includes an engagement surface 200 on which the wrapped container 300 is placed. As described above, the wrapped container 300 includes a container having an outer wrapping 302 that encloses or seals at least part of the container. The outer wrapping 302 may completely enclose the entire container 300 such that the container 300 is entirely closed within and/or sealed inside of the outer wrapping 302. Or, the outer wrapping 302 may extend around part, but not all, of the container 300.

The wrapped container 300 is shown as a cuboid box, but optionally can have another shape with flat and/or curved sides, can have a different number of outer surfaces or sides, or the like. The wrapped container 300 can be a single container or may represent several smaller containers contained within the outer wrapping 302. The outer wrapping 302 can be an enclosure formed from a different material than the container 300. For example, the outer wrapping 302 can be formed from a polymer while the container 300 is formed from a material other than a polymer or a different polymer. In one example, the outer wrapping 302 has a different melting temperature than the material from which the container 300 is formed. For example, the outer wrapping 302 can be formed from cellophane, (or regenerated cellulose and/or diaphane), polyvinyl chloride, or another polymer.

The wrap removal device 102 includes a delivery element 202 on the engagement surface 200. The delivery element 202 is shown as an elongated, linear strip on the engagement surface 200 but may have another shape. For example, the delivery element 202 may be curved or otherwise be non-linear. Optionally, more of the engagement surface 200, all, or substantially all (e.g., at least 90%) of the engagement surface 200 includes the delivery element 202. The delivery element 202 represents one or more bodies that generate energy to cut or weaken the outer wrapping 302 on the container 300. In one embodiment, the delivery element 202 represents one or more heating elements that generate heat to cut through or otherwise weaken the outer wrapping 302. The heating elements can represent one or more resistors or resistive elements (e.g., coils) that generate heat due to application of electric current from a power source (e.g., an electric utility grid). The heating elements may generate heat at a temperature that is greater than melting or phase changing temperature of the outer wrapping 302 but lower than a threshold temperature. The threshold temperature can be a temperature above which the container 300 would burn, scorch, melt, warp, or otherwise be marked by the heat. Optionally, the threshold temperature can be a temperature above which the product(s) within the container 300 would spoil, melt, or be damaged.

In another embodiment, the delivery element 202 represents one or more ultrasound transducers that generate ultrasound waves to cut through or otherwise weaken the outer wrapping 302. The ultrasound transducers can represent one or more piezoelectric bodies that vibrate to generate ultrasound waves. The ultrasound transducers may generate the ultrasound waves at an energy that cuts through or at least weakens the wrapping 302 without damaging, marking, or changing the container 300.

The delivery element 202 is shown as a continuous body in FIG. 2. Alternatively, the delivery element 202 can be formed of several separate elements that generate heat or ultrasound waves. For example, the delivery element 202 can be formed from spaced-apart islands of heating elements or ultrasound transducers that melt, cut, or weaken the wrapping 302 in different locations that are close to each other to cut through or otherwise weaken the wrapping 302 for removal. As one example, the delivery element 202 shown in FIG. 2 can be divided into several squares, circles, or other shapes located along a line defined by the delivery element 202 shown in FIG. 2 (with the squares, circles, or other shapes spaced apart from each other along the line).

The container 300 and wrapping 302 are placed onto the delivery element 202 and the delivery element 202 generates energy (e.g., heat or ultrasound waves) to cut through the wrapping 302 in a location along the delivery element 202.

In one example, the delivery element 202 cuts the wrapping 302 in the locations between the delivery element 202 and the container 300 such that the wrapping 302 is no longer present between the delivery element 202 and the container 300. In another example, the delivery element 202 heats or cuts the wrapping 302 in the locations between the delivery element 202 and the container 300 such that the wrapping 302 is weakened, but is still at least partially present, between the delivery element 202 and the container 300.

Figure 4:
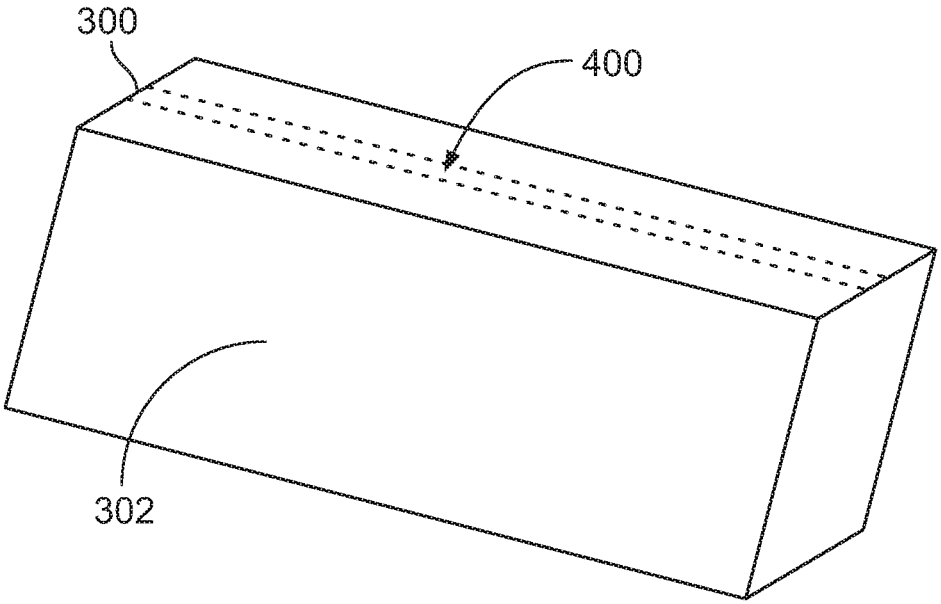
FIG. 4 illustrates the container shown in FIG. 3 with outer wrapping cut or weakened by the wrap removal device shown in FIG. 2.

FIG. 4 illustrates the container 300 with the wrapping 302 cut or weakened by the delivery element 202 of the wrap removal device 102 shown in FIG. 2. As shown, the wrapping 302 is cut or weakened along a path 400. This path 400 corresponds to the locations of the wrapping 302 located between the delivery element 202 of the wrap removal device 200. The bottom surface of the container 300 in FIG. 3 is shown as the top surface in FIG. 4. Stated differently, the container 300 is shown flipped over relative to the view in FIG. 3. The path 400 can represent locations where the wrapping 302 is melted and no longer exists. Optionally, the path 400 can represent locations where the wrapping 302 is weakened relative to other locations of the wrapping 302 (e.g., for easier tearing of the wrapping 302). While the path 400 is shown as being oriented along the longest axis of the container 300, the path 400 may be oriented along another direction, such as a shorter axis of the container 300, along a direction that is acutely or obliquely oriented to an axis of the container 300, etc.

Figure 5:
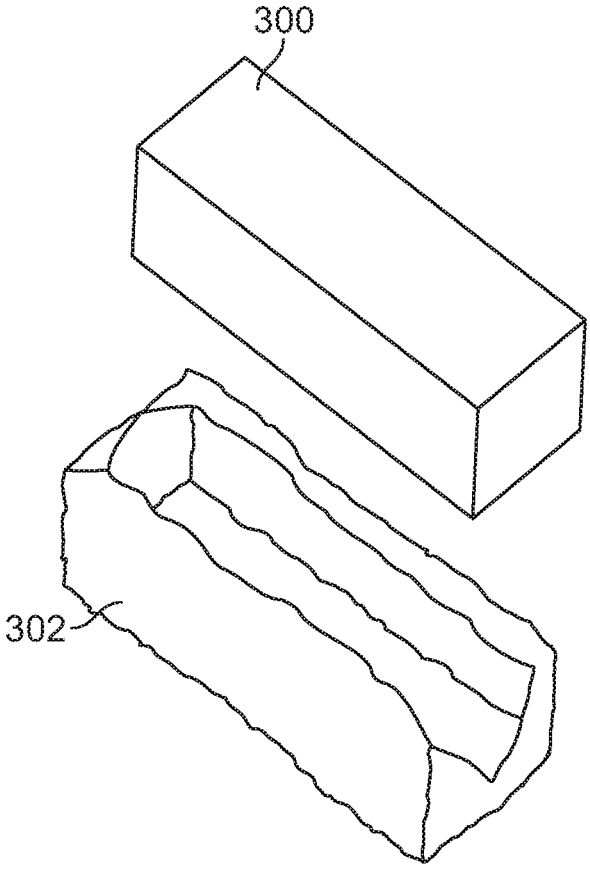
FIG. 5 illustrates the container shown in FIG. 3 with the wrapping removed along a path shown in FIG. 5.

FIG. 5 illustrates the container 300 with the wrapping 302 removed along the path 400 shown in FIG. 5. The wrapping 302 can be removed from the container 300 by pulling the wrapper 302 away from the container 300. This removal can be achieved by manually grasping and pulling any part of the wrapping 302 away from the container 300, by inserting an object (e.g., a finger projection) into the path 400 while the projection moves relative to the container 300 and/or the container 300 moves relative to the projection, etc. As shown, the wrapping 302 can be removed as a single piece from the container 300. This can make for faster and quicker removal and disposal of the wrapping 302. For example, removed wrapping 302 that is separated into multiple pieces can be more difficult and time-consuming to disposed of because the multiple pieces may each need to be picked up before being discarded.

Figure 6:
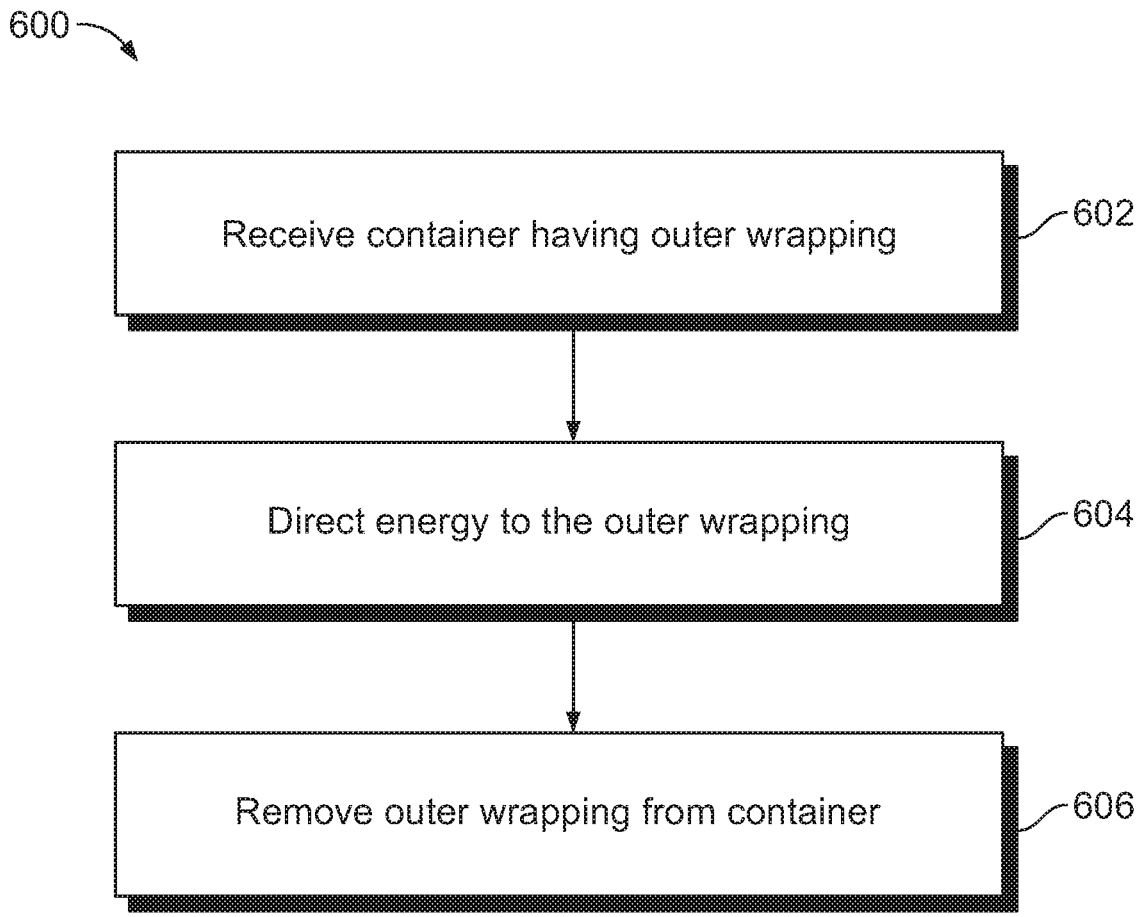
FIG. 6 illustrates a flowchart of one embodiment of a method for removing an outer wrapping from a container.

FIG. 6 illustrates a flowchart of one embodiment of a method 600 for removing an outer wrapping from a container. The method 600 can represent the operations performed by and/or using the wrap removal device 102 shown in FIG. 1. At 602, a container having an outer wrapping is received on the engagement surface of the wrap removal device. The engagement surface includes the delivery element described above. At 604, energy is directed to the outer wrapping by the delivery element of the wrap removal device. This energy can be heat that melts, partially melts, or otherwise weakens part of the outer wrapping. Alternatively, this energy can be ultrasound waves that cut or otherwise weaken part of the outer wrapping. At 606, the outer wrapping is removed from the container. For example, the outer wrapping is pulled from the container such that the container exits the outer wrapping via the path that is melted, cut, or otherwise weakened by the delivery element of the wrap removal device. Part of the outer wrapping that is connected with this path (e.g., at the ends of the path) may tear during removal of the outer wrapping.

In one embodiment, a wrap removal device includes (a) an engagement surface configured to receive a container having an outer wrapping and (b) one or more delivery elements disposed on or in the engagement surface. The one or more delivery elements are configured to generate energy that one or more of melts, cuts, or weakens the outer wrapping along a path without melting, cutting, or modifying the container.

Optionally, the one or more delivery elements are configured to generate heat that melts the outer wrapping along the path without melting, scorching, warping, or marking the container.

Optionally, the one or more delivery elements are configured to generate heat that weakens the outer wrapping along the path without melting, scorching, warping, or marking the container and without melting the outer wrapping along the path.

Optionally, the one or more delivery elements are configured to generate ultrasound waves that cut the outer wrapping along the path without cutting, damaging, or marking the container.

Optionally, the one or more delivery elements are configured to generate ultrasound waves that weaken the outer wrapping along the path without cutting, damaging, or marking the container and without cutting the outer wrapping along the path.

Optionally, the one or more delivery elements are configured to generate the energy along the path of the outer wrapping such that the outer wrapping is melted, cut, or weakened along the path and is removed from the container along the path as a single piece of the outer wrapping.

Optionally, the one or more delivery elements are configured to generate the energy to melt or cut the outer wrapping formed from a first polymer without melting or cutting the container that is formed from a different, second polymer or a material that is not a polymer.

Optionally, the first polymer from which the outer wrapping is formed is regenerated cellulose.

In one embodiment, a wrap removal device includes (a) an engagement surface configured to receive a container having an outer wrapping and (b) one or more delivery elements disposed on or in the engagement surface. The one or more delivery elements are configured to generate heat that one or more of melts or weakens the outer wrapping along a path without melting or modifying the container.

Optionally, the one or more delivery elements are configured to generate the heat that melts the outer wrapping along the path without melting, scorching, warping, or marking the container.

Optionally, the one or more delivery elements are configured to generate the heat that weakens the outer wrapping along the path without melting, scorching, warping, or marking the container and without melting the outer wrapping along the path.

Optionally, the one or more delivery elements are configured to generate the energy along the path of the outer wrapping such that the outer wrapping is melted or weakened along the path and is removed from the container along the path as a single piece of the outer wrapping.

Optionally, the one or more delivery elements are configured to generate the energy to melt the outer wrapping formed from a first polymer without melting the container that is formed from a different, second polymer or a material that is not a polymer.

Optionally, the one or more delivery elements includes an elongated, linear heating element that generates the heat.

In one embodiment, a wrap removal device includes (a) an engagement surface configured to receive a container having an outer wrapping and (b) one or more delivery elements disposed on or in the engagement surface. The one or more delivery elements are configured to generate ultrasound energy that one or more of cuts or weakens the outer wrapping along a path without cutting or modifying the container.

Optionally, the one or more delivery elements are configured to generate the ultrasound waves that cut the outer wrapping along the path without marking the container.

Optionally, the one or more delivery elements are configured to generate the ultrasound waves that weaken the outer wrapping along the path without marking the container and without cutting the outer wrapping along the path.

Optionally, the one or more delivery elements are configured to generate the energy along the path of the outer wrapping such that the outer wrapping is cut or weakened along the path and is removed from the container along the path as a single piece of the outer wrapping.

Optionally, the one or more delivery elements are configured to generate the energy to cut or weaken the outer wrapping formed from a first polymer without cutting or weakening the container that is formed from a different, second polymer or a material that is not a polymer.

Optionally, the one or more delivery elements include one or more piezoelectric elements located along an elongated, linear path.

The singular forms "a", "an", and "the" include plural references unless the context clearly dictates otherwise. "Optional" or "optionally" means that the subsequently described event or circumstance may or may not occur, and that the description may include instances where the event occurs and instances where it does not. Approximating language, as used herein throughout the specification and claims, may be applied to modify any quantitative representation that could permissibly vary without resulting in a change in the basic function to which it may be related. Accordingly, a value modified by a term or terms, such as "about," "substantially," and "approximately," may be not to be limited to the precise value specified. In at least some instances, the approximating language may correspond to the precision of an instrument for measuring the value. Here and throughout the specification and claims, range limitations may be combined and/or interchanged, such ranges may be identified and include all the sub-ranges contained therein unless context or language indicates otherwise.

This written description uses examples to disclose the embodiments, including the best mode, and to enable a person of ordinary skill in the art to practice the embodiments, including making and using any devices or systems and performing any incorporated methods. The claims define the patentable scope of the disclosure, and include other examples that occur to those of ordinary skill in the art. Such other examples are intended to be within the scope of the claims if they have structural elements that do not differ from the literal language of the claims, or if they include equivalent structural elements with insubstantial differences from the literal language of the claims.

What is claimed is:

1. A device comprising:

an engagement surface configured to receive a container having an outer polymer wrapping; and a single linear strip of a delivery element disposed in the engagement surface, the single linear strip of the delivery element configured to generate ultrasound energy or heat that cuts the outer polymer wrapping along a single linear path without cutting or modifying the container.

2. The device of claim 1, wherein the single linear strip of the delivery element is configured to generate the ultrasound energy or heat to cut the outer polymer wrapping without cutting or weakening the container that is formed from a different, second polymer or a material that is not a polymer.

3. The device of claim 1, wherein the linear strip of the delivery element includes one or more piezoelectric elements.

* * * * *